United States Patent [19]

Küng

[11] 4,201,361

[45] May 6, 1980

[54] CONCRETE FORM COMPONENT

[76] Inventor: Herbert Küng, Untermättli 566, 8913 Ottenbach, Fed. Rep. of Germany

[21] Appl. No.: 18,246

[22] Filed: Mar. 7, 1979

[30] Foreign Application Priority Data

Mar. 9, 1978 [DE] Fed. Rep. of Germany ..... 2810287

[51] Int. Cl.[2] ..... F16M 11/14

[52] U.S. Cl. ..... 249/183; 249/153; 249/179

[58] Field of Search ..... 249/183, 179, 153; 425/44

[56] References Cited

U.S. PATENT DOCUMENTS 2,623,261 12/1952 Semararo ..... 249/183

3,074,140 1/1963 Balcomb et al. ..... 249/183

*Primary Examiner*—William E. Schulz

[57] ABSTRACT

The invention relates to a formwork component for use in concrete construction for the formation of a recess in a wall or ceiling, the component comprising a hollow body defining a central axis, the body having a resilient wall and at least one spreader mechanism adapted to adjust the shape of the hollow body to vary its cross-sectional dimensions. In a first aspect the resilient wall includes at least one section bendable about an axis substantially co-planar with the central axis. The spreader mechanism may include at least one movable spreader component adapted to act on the resilient wall as a hinged lever.

25 Claims, 9 Drawing Figures

Figure 2:
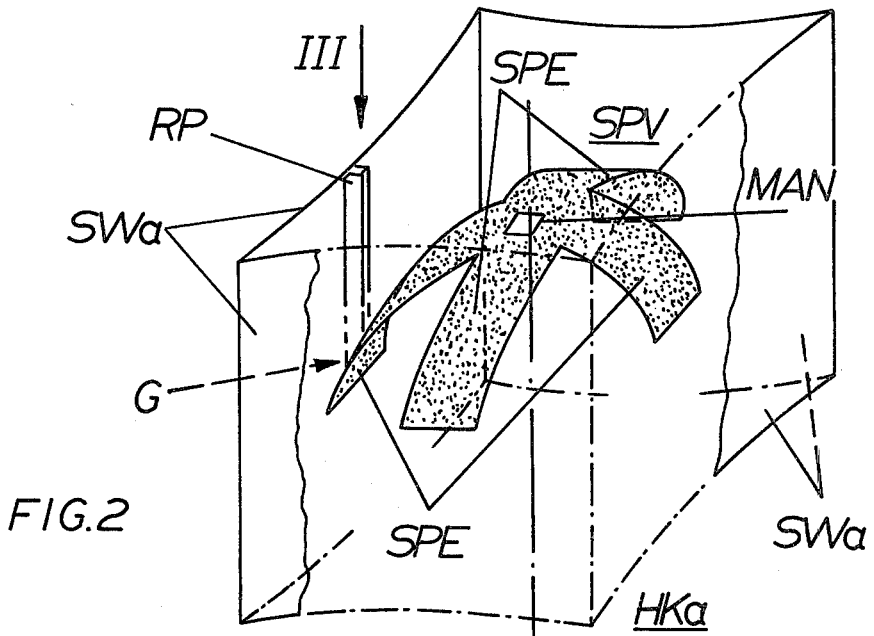

SPEa
KT
GA
BGLc
SWd
AR
BGc
HKc
SG
SPL

BGLa
BGLb
SWc
KT
SPEa
BGLc

BGLb
HKc
SWd
SPEa
SWc
BGLc
BGLa

CONCRETE FORM COMPONENT

CONCRETE FORM COMPONENT

The invention refers to a formwork component for use in concrete construction for the formation of a recess in a wall or ceiling, said component comprising a hollow body defining a central axis, said body having a resilient wall and at least one spreader mechanism adapted to adjust the shape of said hollow body to vary its cross-sectional dimensions.

Such formwork components are usually put together on the spot from pieces of wood and connected to the adjacent parts of the formwork, e.g., with a panel defining the wall or ceiling. The outer shape of the hollow body is in general prismatic or cylindrical, where necessary slightly wedge-shaped or conical, in order to facilitate removal after setting of the concrete. But in practice this removal turns out to be difficult and timewasting because of the adhesion between the concrete and the surface of the formwork unless costly parting compounds are applied to the surface of the formwork or destruction of the component is acceptable.

The object of the invention is therefore the creation of a formwork component of the kind mentioned initially, which is distinguished by simple construction and ability to be produced economically as well as the ability to be re-used.

According to one aspect of the invention such a component comprises a hollow body defining a central axis, said body having a resilient wall and at least one spreader mechanism adapted to adjust the shape of said hollow body to vary its cross-sectional dimensions, said resilient wall including at least one section bendable about an axis substantially co-planar with said central axis.

According to a second aspect of the invention such a component comprises a hollow body defining a central axis, said body having a resilient wall and at least one spreader mechanism adapted to adjust the shape of said hollow body to vary its cross-sectional dimensions, said spreader mechanism including at least one movable spreader component adapted to act on said resilient wall as a hinged lever.

What is common to the main variants upon the solution in accordance with the invention is the arrangement of yielding or bendable components respectively in the region of the wall of the hollow body or respectively in the region of the spreader mechanism. The simple construction being striven for in accordance with the object, ability of re-use of the component, is thereby achieved. In particular the employment of integral bending hinges which are preferably made as strip-like thin parts inside the wall of the hollow body of the component enables simple production at favourable cost of the hollow body in a one-piece execution from plastics by means of comparatively simple injection or compression moulding. The same goes too for the construction of the spreader mechanism in which case spreader components may be made use of which act after the style of a lever mechanism and are bendable or resistant to bending respectively and connected by bending hinges. Moreover such a spreader component may also be made cross- or star-shaped and arranged inside the hollow body. Above all it is possible to have a one piece construction of the component inclusive of its spreader mechanism as well as if necessary also inclusive of a fastener consisting of suitable rigid plastics for fitting to a formwork panel. Such a fastener may at the same time be made as an actuator member for the spreading or respectively the changeover of the hollow body between the shape of the recess provided for on the one hand and the shape with correspondingly reduced cross-section for removal from the formwork.

The axial positioning forces for the spreader mechanism are produced particularly simply and advantageously by means of a suitable securable actuator member which advantageously is made at the same time as a fastener for the whole formwork component to the adjacent formwork. For doing this stepped snap-connection components or simple nail- or bolt-like components are particularly useful. The latter may, e.g., be driven through the apex of the spreader mechanism into a panel of the form arranged at the front with respect to the hollow body or the like, in which case the head of the nail or bolt engages with the spreader mechanism and forces apart the sidewalls of the hollow body. If the nail or bolt is connected suitably to the spreader mechanism it may upon withdrawal be employed also as actuator member for the folding-together movement of the spreader mechanism and hence for the inwards deformation of the hollow body. This results in a further simplification and cheapening of the whole construction.

Figure 1:
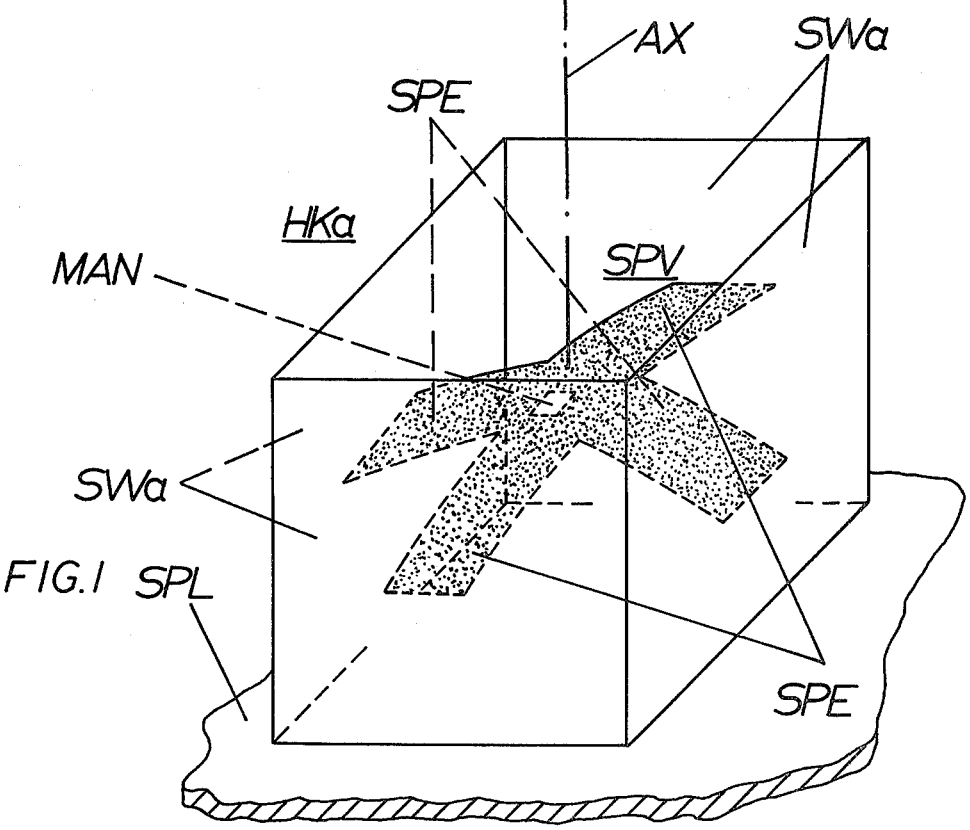
Figures 3, 4:
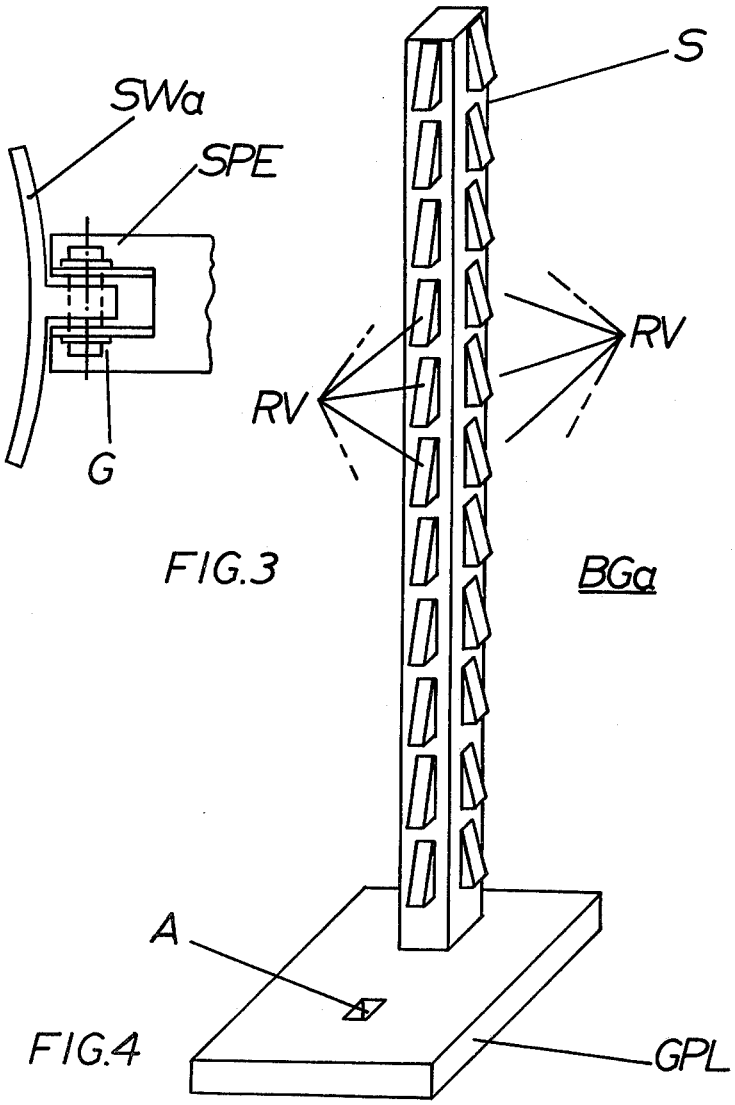
Figure 5:
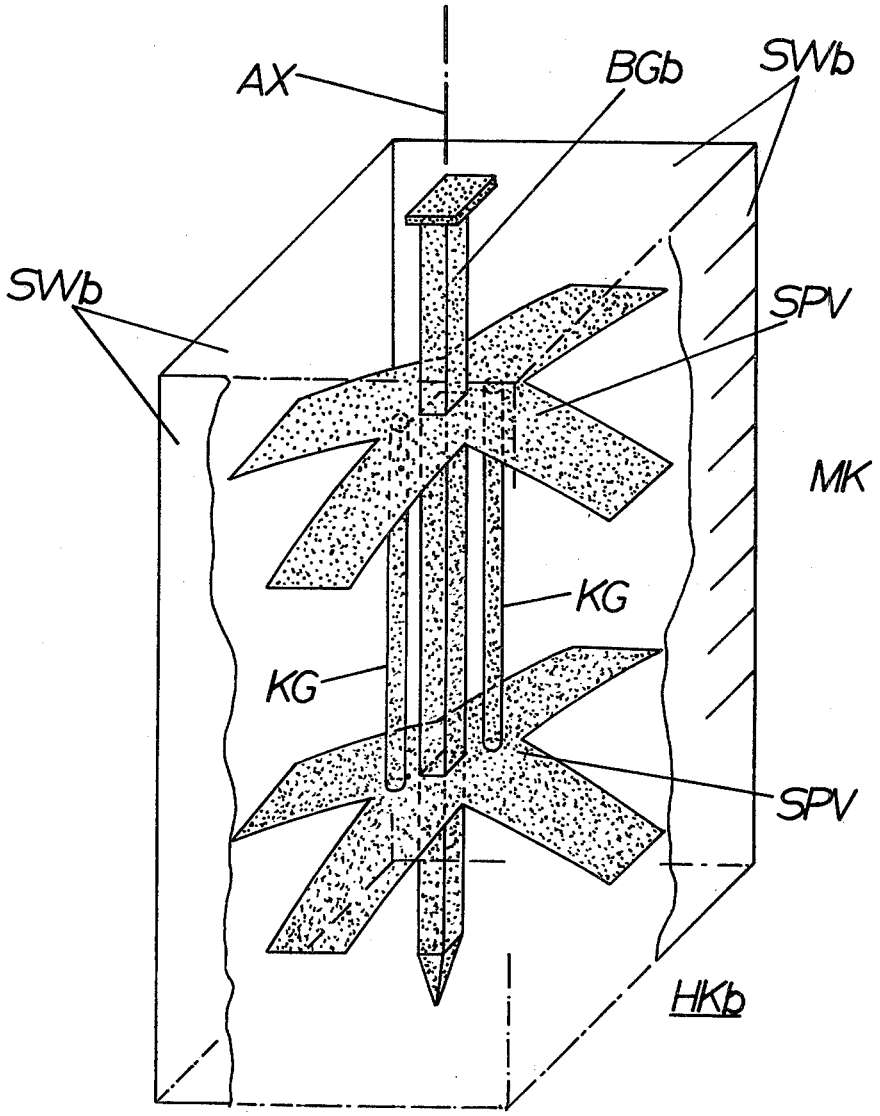
Figure 6:
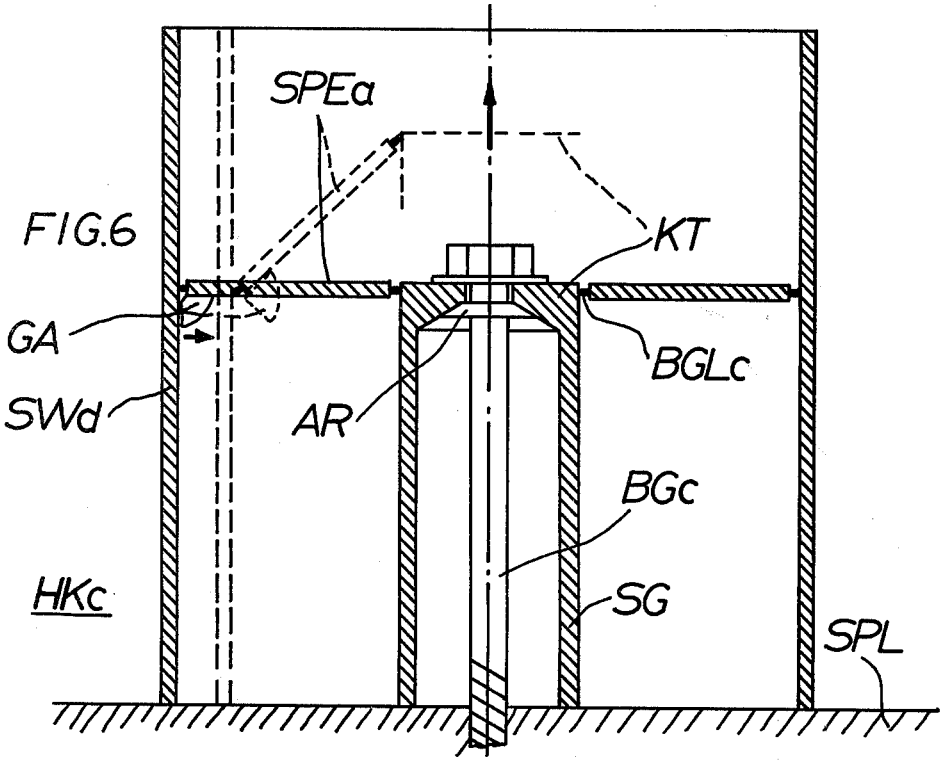
Figure 7:
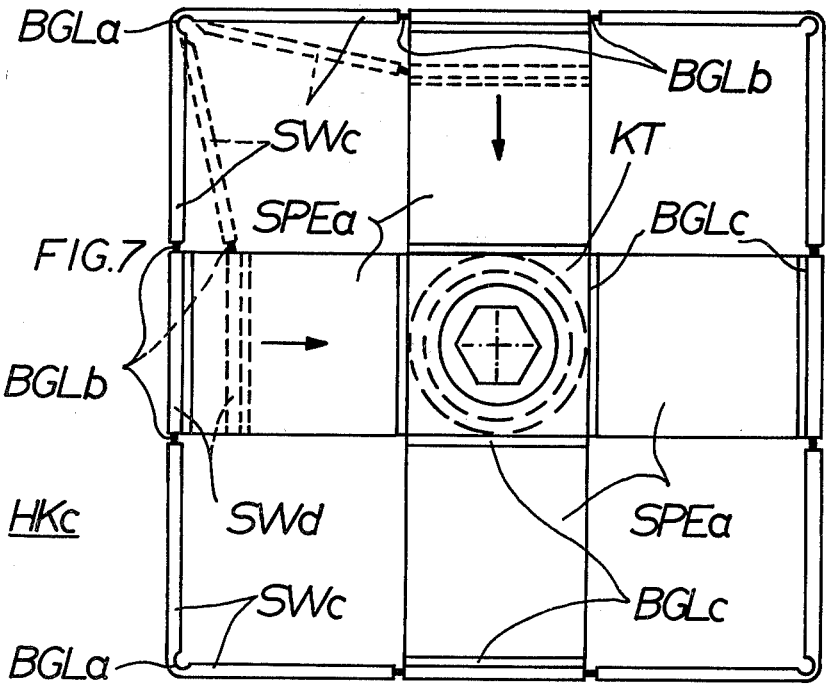
Figure 8:
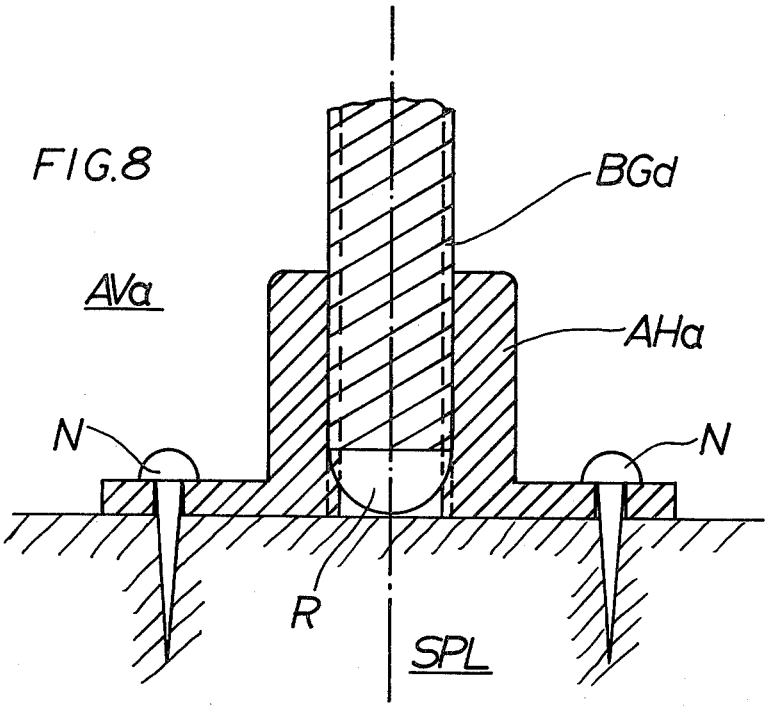
Figure 9:
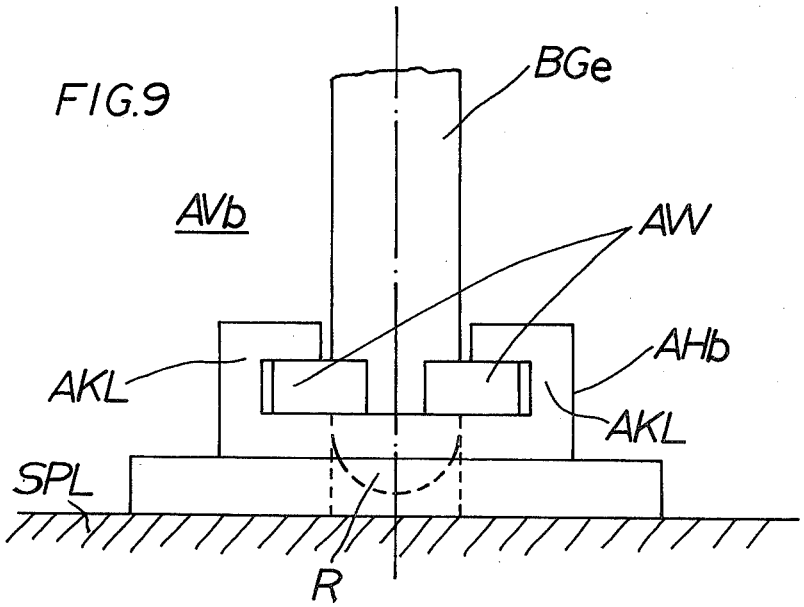

Further features and advantages of the invention are explained with the aid of embodiments illustrated in the drawings. In these there is shown in:

FIG. 1—a box like component of a form with a spreader mechanism accommodated inside it in the state for assembly;

FIG. 2—the component of a form as in FIG. 1 in the state deformed inwards for dismantling;

FIG. 3—a structural detail of the component of a form as in FIG. 2 looking in the direction of the arrow III;

FIG. 4—a combined actuator component and fastener with a stepped snap-connection for a component of a form with a push or pull mechanism respectively in accordance with FIGS. 1 and 2;

FIG. 5—an embodiment of a box-shaped component of a form having two spreader mechanisms lying one above the other;

FIG. 6—a further embodiment of a component of a form having a spreader mechanism in one piece execution in axial section;

FIG. 7—a plan of the component of a form as in FIG. 6;

FIG. 8—an anchor device for the fastening of a component of a form to a panel of a form; and FIG. 9—another embodiment of an anchor similar to the execution as FIG. 8.

The formwork component shown in FIGS. 1 and 2 comprises a box-shaped hollow body HKa open at its top and bottom and having comparatively thin elastically deformable sidewalls SWa. In FIG. 1 the body is shown in an expanded state for assembly, the bottom endface of the hollow body being seated on a formwork panel SPL (shown partially cut away) which supports, during its casting, say a concrete ceiling (not shown) of a thickness corresponding wholly or partially with the height of the box. Inside the hollow body there is provided a spreader mechanism SPV of cruciform shap having stiffly elastically bendable arms SPE which engage the sidewalls of the hollow body through hinges to be described in detail below. In the case of a component having a polygonal (e.g. hexagonal) or cylindrical cross-section the spreader mechanism may have a star-shaped construction.

In the unexpanded state prior to assembly of the component in its position the spreader mechanism SPV has an arched shaped upwards in the axial direction AX so that a fastener, for example a nail, which penetrates through a central opening MAN in the spreader mechanism SPV can be engaged with, in the case of a nail driven into, the formwork panel SPL and by engagement with the mechanism SPV, causes spreading out of the components SPE. In so doing the spreader components SPE move the sidewalls SWa into the position shown in FIG. 1 and support them against the external pressure of the concrete when it is poured. The spreading out of the hollow body may be carried out until even a convex curvature of the sidewalls of the hollow body results. In this way the cross-sectional shape can be adjusted to varying dimensions depending on the desired shape of the recess to be produced.

In FIG. 2 the spreader mechanism, in comparison with FIG. 1, is shown arched so strongly upwards that the sidewalls are curved inwardly and a reduction in the cross sectional area of the hollow body results. A prerequisite for this is obviously the prior loosening of the fastener which attaches the spreader mechanism to the panel SPL (not shown in FIG. 2). The increased arching of the spreader mechanism thereafter may be performed easily by a hook-shaped tool which is inserted in the central opening MAN.

During outwards and inwards deformation of the sidewalls of the hollow body it is essential that the straight generatrices of the prism or cylinder are not deformed into a curve. Such deformation may arise in the centre of the sidewalls in the case of the engagement of a push or pull mechanism and in the case of an outwards deformation would lead to a concavely arched shape of the opening in the concrete and in the case of inwards deformation would lead to insufficient loosening of the outer surface of the formwork component during dismantling. Where necessary, therefore, a stiffening of the sidewalls in the axial direction of the hollow body is recommended, preferably by means of one or more stiffening ribs RP.

In FIG. 2 such stiffening rib is indicated diagrammatically on only one sidewall of the hollow body at its centre. The spreader mechanism engages the central rib, preferably through a hinge G of a simple kind such as is illustrated in FIG. 3.

FIG. 4 illustrates a combined actuator component and fastener BGa for a spreader mechanism such as shown in FIGS. 1 and 2, which consists of a base plate GPL, to be fastened by nailing (through for example the hole A) to say a panel SPL such as shown in FIG. 1, and a serrated bar S mounted perpendicular to it. The bar S forms a stepped snap-connection RV which cooperates with the central opening MAN in the spreader mechanism. With a suitable elastically yielding construction of this central opening or respectively of the central part of the spreader mechanism the spreader mechanism can easily be forced into the saw-tooth bar until the required bracing of the sidewalls is achieved.

FIG. 5 illustrates a second box-like formwork component having a hollow body HKb having a greater dimension in the axial direction and two spreader mechanisms SPV arranged spaced apart along its axis. By using two spreader mechanisms the points of application of the deforming and supporting forces are spread over the height of the sidewalls SWb and the risk of bulging of the sidewalls is reduced.

For the purpose of simple operation of the formwork component during assembly and dismantling, the two spreader mechanisms SPV are connected together by two coupling members KG—here, for example, simple bars—which extend in the axial direction AX. Where necessary a single coupling member, e.g., a concentric sleeve may be used instead.

FIG. 5 also illustrates a nail-like fastener BGb for use in spreading the body by engagement of its head during driving in against the uppermost spreader mechanism SPV. This combined actuator and fastener member BGb may, if required, be connected also by suitable projections, or the like to both of the spreader mechanisms, so that a special coupling between the two spreader mechanisms is not necessary. The formwork component can thus be made in particular as a single unit with spreader mechanism and actuator as well as fastener component.

On the outer face of the hollow body HKb (as shown in FIG. 5) markings MK are provided, arranged spaced apart in the axial direction AX, and which during pouring of the concrete into ceiling formwork allows the height of fill reached at any time to be read off in a particularly simple way.

FIGS. 6 and 7 show a formwork component made in one piece and having a hollow plastics body HKc in position for concreting supported on a panel SPL. The hollow body is fitted to the latter by means of a central fastening screw in the form of a spread-actuation member BGc which bears against the panel via a combined distance-piece and supporting member SG. The spread position of the hollow body is also thereby clearly determined by the corresponding position of the spreader components SPEa again arranged in the form of a cross. These spreader components are connected, by integral, bending hinges BGLc in the form of thin strips, inside the one piece plastics body, at one end to a central coupling part KT at the head end of the supporting member SG and at the other end to central sections of the sidewalls SWb. If necessary, security against raising of the hollow body from the panel of the form can be achieved by means of the hinge stops GA indicated on the left hand side of FIG. 6, which bring about locking of the spreader components against pivoting to one side and thereby enable the hollow body to be held firmly against the panel of the form. Such hinge stops may obviously be provided in some other way, for example, between the spreader components and the central coupling part or supporting member respectively. Locking against pivoting on one side is also possible by means of tension components which can yield in a softly elastic way in the other direction of pivoting.

The screw-threaded actuation member BGc may not only hold the component in the shape for concreting illustrated in solid line in FIGS. 6 and 7, but also by its unscrewing can cause the shape to be changed into the position partially illustrated in dotted lines in FIGS. 6 and 7 for removal of the formwork, a stop ring AR resting against the underside of the coupling part KT which connects the spreader components and raising their inner ends in the direction of the arrow in FIG. 6. In so doing, the sections of sidewall SWb shown in dotted line in FIGS. 6 and 7 are shifted inwards in the direction of the arrows. In doing so the sections of sidewall SWc of the hollow body, connected by further integral, bending hinges BGLb adopt the position indicated in dotted line in FIG. 7 and consequently are likewise released from the concrete. In this case the edges of the prismatic hollow body formed by further integral, bending, hinges BGLa are moved diagonally inwards, whereby the release from the set concrete is particularly facilitated.

The component shown in FIG. 6 and 7 has the particular advantage of being able to be produced from mouldable plastics in an injection or compression mould free of back tapers. This applies even as regards possible hinge stops GA because the moulding may be performed in a slightly angled position of the spreader components such as illustrated in dotted lines in FIG. 6. The integral, bending, hinges are formed, as known per se in a particularly simple way by appropriate design of thin parts in the plastics wall.

For the releasable anchoring of a formwork component of the present kind, but fundamentally also for other if necessary even non-deformable components of a form, devices shown in FIGS. 8 and 9 can be used.

The anchoring device AVa shown in FIG. 8 is provided for screwing in a bolt like fastener BGd provided with a coarse thread which for the purpose of easier introduction of the tip of the screw has a rounding-off R. The anchoring device comprises an anchor sheath AHa with a corresponding internal thread and a shoe for releasable fastening by means of nails N to a formwork panel SPL. The release of the anchor sheath from the panel may be effected after removal of the panel from the concrete whereupon the points of fastening to the panel are freely accessible to suitable tools.

The anchoring device AVb shown in FIG. 9 has an anchor sheath AHb again fastened detachably to a panel SPL (in a way not shown), and which by means of anchor claws AKL open at the side embraces corresponding anchor lugs AW at the tip of a bolt like fastener BGe and locks them axially. For use the tip of the fastener, provided with a rounding-off R, is introduced into the hole in the anchor sheath AHb in a rotational position such that the anchor lugs AW penetrate into the lateral openings (in FIG. 9 in front and behind) between the anchor claws AKL. Then the fastening is completed by twisting of the fastener into the locking position illustrated.

I claim:

1. A formwork component for use in concrete construction for the formation of a recess in a wall or ceiling, said component comprising a hollow body defining a central axis, said body having a resilient wall and at least one spreader mechanism adapted to adjust the shape of said hollow body to vary its cross-sectional dimensions, said resilient wall including at least one section bendable about an axis substantially co-planar with said central axis.

2. A component according to claim 1, wherein said resilient wall includes an integral bending hinge, said bending hinge defining said bending axis.

3. A component according to claim 1, wherein said resilient wall comprises a plurality of sections, said sections being comparatively resistant to bending, and being connected together by means of integral bending hinges.

4. A formwork component for use in concrete construction for the formation of a recess in a wall or ceiling, said component comprising a hollow body defining a central axis, said body having a resilient wall and at least one spreader mechanism adapted to adjust the shape of said hollow body to vary its cross-sectional dimensions, said spreader mechanism including at least one movable spreader component adapted to act on said resilient wall as a hinged lever.

5. A component according to claim 4, in which said wall comprises at least two sections, said spreader mechanism including at least one stiffly elastically bendable spreader component adapted to act upon said two sections of said wall.

6. A component according to claim 5, wherein said spreader component comprises a thin, plate-like member and is connected to the inside of the hollow body.

7. A component according to claim 4, wherein said wall comprises a plurality of sections, said spreader mechanism including at least two spreader components substantially resistant to bending, said spreader components being pivotally connected by means of integral bending hinges to corresponding ones of said sections.

8. A component according to claim 7, wherein said spreader components are also connected to a spread-actuator member.

9. A component according to claim 7, wherein said spreader components are also connected to a coupling part.

10. A component according to claim 4 or claim 5, in which said spreader mechanism has a cruciform shape.

11. A component according to claim 4 or claim 5, in which said spreader mechanism has a star shape.

12. A component according to claim 4, in which at least two spreader mechanisms are provided, said spreader mechanisms being axially spaced apart.

13. A component according to claim 12, wherein a coupling member connects said spreader mechanisms, said coupling member extending in said axial direction.

14. A component according to claim 5, in which said spreader components form a lever mechanism, and further including integral bending hinges connecting said spreader components to said sections of sidewall.

15. A component according to claim 14, in which said bending hinges are substantially resistant to bending in the direction transverse to the said central axis.

16. A component according to claim 1 or claim 4, wherein said hollow body comprises a stiffly elastic plastics material, said hollow body being formed in one piece.

17. A component according to claim 4, which includes an actuator member for said spreader mechanism, said member comprising a fastener adapted to hold said hollow body in a shape having an enlarged cross-section.

18. A component according to claim 17, wherein said member has a serrated profile.

19. A component according to claim 18, in which said member comprises a saw-toothed bar said bar being adaptable to penetrate through an elastically yielding opening defined in said spreader mechanism.

20. A component according to claim 7, which includes an actuator member for said spreader mechanism, said member comprising a fastener adapted to hold said hollow body in a shape having an enlarged cross-section.

21. A component according to claim 20, wherein said actuator member comprises a coupling member between said spreader mechanisms.

22. A component according to claim 17 or claim 21, wherein said fastener comprises a coarsely screw-threaded member, said member engaging with an anchor sheath provided with a corresponding thread and releasable fastening means.

23. A component according to claim 17 or claim 21, wherein said fastener comprises an anchor device adapted to be fitted releasably to an anchor component by means of a bayonet joint.

24. A component according to claim 4, wherein said spreader component is locked against movement in one direction by means of a hinge stop.

25. A component according to claim 1 or claim 4, in which markings are provided on at least one outer face of said hollow body spaced apart in the axial direction.

* * * * *

UNITED STATES PATENT AND TRADEMARK OFFICE

CERTIFICATE OF CORRECTION

PATENT NO. : 4,201,361

DATED : May 6, 1980

INVENTOR(S) : Herbert Kung

It is certified that error appears in the above-identified patent and that said Letters Patent are hereby corrected as shown below:

Cover Page, left hand column, line 3 (item 76)

Change "Fed. Rep. of Germany" to --Switzerland--.

Signed and Sealed this

*Twenty-first* Day of *October 1980*

[SEAL]

*Attest:*

SIDNEY A. DIAMOND

*Attesting Officer*

*Commissioner of Patents and Trademarks*